US005620949A

United States Patent [19]

Baker et al.

[11] Patent Number: 5,620,949

[45] Date of Patent: Apr. 15, 1997

[54] CONDENSATION PRODUCTS OF ALKYLPHENOLS AND ALDEHYDES, AND DERIVATIVES THEREOF

[75] Inventors: Mark R. Baker, Lyndhurst; Marvin B. DeTar, Wickliffe, both of Ohio

[73] Assignee: The Lubrizol Corporation, Wickliffe, Ohio

[21] Appl. No.: 571,485

[22] Filed: Dec. 13, 1995

[51] Int. Cl.[6] ..... C10M 129/00; C10M 145/00

[52] U.S. Cl. ..... 508/452; 508/453; 508/455; 508/457; 549/307; 556/49; 556/131; 556/147; 560/57; 562/468

[58] Field of Search ..... 549/307; 560/57; 562/468; 252/52 R, 51.5 A, 56 R, 39, 41, 34; 556/49, 131, 147; 508/452, 453, 457, 455

[56] References Cited

U.S. PATENT DOCUMENTS

| | | | |
|---|---|---|---|
| T904,003 | 11/1972 | Salminer | 549/307 |
| 2,320,241 | 5/1943 | Jenkins . | |
| 2,933,520 | 4/1960 | Badger | 260/473 |
| 3,038,935 | 6/1962 | Gerber et al. | 260/520 |
| 3,471,537 | 10/1969 | Berke et al. | 260/429 |
| 3,793,201 | 2/1974 | Karn . | |
| 3,862,133 | 1/1975 | Layer | 260/343.3 |
| 3,862,965 | 12/1958 | Gündel et al. | 260/470 |
| 4,013,690 | 3/1977 | Closse et al. | 260/343.3 |
| 4,384,138 | 5/1983 | Karll et al. | 562/478 |
| 4,627,298 | 12/1986 | Karn . | |
| 5,039,437 | 8/1991 | Martella et al. . | |
| 5,112,743 | 5/1992 | Kamiya et al. | 430/175 |
| 5,175,312 | 12/1992 | Dubs et al. | 549/307 |
| 5,260,430 | 11/1993 | Nesvadba | 560/57 |
| 5,281,346 | 1/1994 | Adams . | |
| 5,336,278 | 8/1994 | Adams et al. | 44/419 |
| 5,356,546 | 10/1994 | Blystone et al. . | |
| 5,441,653 | 8/1995 | Cleveland et al. . | |
| 5,488,117 | 1/1996 | Nesvadba | 549/302 |

OTHER PUBLICATIONS

08323982 Aug. 17, 1994 Karn et al.

*Primary Examiner*—Jacqueline V. Howard
*Assistant Examiner*—Cephia D. Toomer
*Attorney, Agent, or Firm*—David M. Shold; Frederick D. Hunter

[57] ABSTRACT

The reaction product of a hydroxyaromatic compound, at least some of the units of which are hydrocarbyl-substituted, a carboxy-substituted aldehyde, and an aldehyde other than a carboxy-substituted aldehyde, provides an additive for lubricants as well as an intermediate for further reaction with amines, alcohols, or neutralization to form a salt.

51 Claims, No Drawings

CONDENSATION PRODUCTS OF ALKYLPHENOLS AND ALDEHYDES, AND DERIVATIVES THEREOF

BACKGROUND OF THE INVENTION

The present invention relates to adducts of hydrocarbyl substituted phenols, carbonyl compounds, and carboxy-substituted carbonyl compounds, and dispersants prepared therefrom, useful as lubricant additives.

Condensation products of hydrocarbyl phenols and carboxy-substituted aldehydes, such as glyoxylic acid, are known. For example, U.S. Pat. No. 5,281,346, Adams, Jan. 25, 1994, discloses a two-cycle engine lubricant comprising alkali or alkaline earth metal salts of carboxylic aromatic acids having a formula (II)

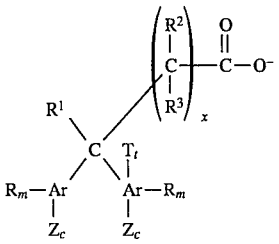

wherein T is selected from the group consisting of

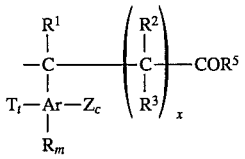

or

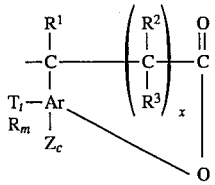

U.S. Pat. No. 5,356,546, Blystone et al, Oct. 18, 1994, discloses metal salts similar to those of U.S. Pat. No. 5,281,346. The salts find utility in lubricants and fuels other than 2-cycle engine lubricants and fuels.

Condensation products of phenols and formaldehyde are also known. For example, U.S. Pat. No. 3,793,201, Karn, Feb. 19, 1974, discloses polyvalent metal salts of bridged phenols, which are alkylated phenol-formaldehyde condensation products.

U.S. Pat. No. 5,039,437, Martella et al., Aug. 13, 1991, discloses alkylphenol-formaldehyde condensates as lubricating oil additives. The alkyl groups are essentially linear, have between 6 and 50 carbon atoms, and have an average number of carbon atoms between about 12 and 26. Blends of these additives with middle distillates and lubricating oil compositions, whose low temperature flow properties are significantly improved thereby are disclosed.

SUMMARY OF THE INVENTION

The present invention provides a composition of matter comprising the reaction product of a hydroxyaromatic compound, at least some of the units of which are hydrocarbyl-substituted provided that if the hydroxyaromatic compound comprises bridged ring units, then substantially all such units are hydroxyl- and hydrocarbyl-substituted; a carboxy-substituted carbonyl compound, or a source thereof; and a carbonyl compound other than a carboxy-substituted carbonyl compound, or a source thereof. The invention further provides the reaction product of the above composition of matter with an amine, a polyol, or a polyol ether, or with a salt-forming metal species to form a salt. The invention further provides a lubricant comprising an oil of lubricating viscosity and a minor amount of the above composition, and a concentrate comprising the above composition and a concentrate-forming amount of an oil of lubricating viscosity. The invention further comprises a method for lubricating an internal combustion engine, comprising supplying to the engine such a lubricant.

DETAILED DESCRIPTION OF THE INVENTION

The present invention includes the reaction product of a hydroxyaromatic compound, a carboxy-substituted carbonyl compound, or a source thereof, and a carbonyl compound other than a carboxy-substituted carbonyl compound, or a source thereof. The first of these reactants is a hydroxyaromatic compound, at least some of the units of which are hydrocarbyl-substituted.

The aromatic group of the hydroxyaromatic compound can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein pairs of aromatic nuclei making up the aromatic group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in the aromatic group between aromatic nuclei. For example, a fluorene nucleus has two benzene nuclei linked by both a methylene linkage and a covalent bond. Such a nucleus may be considered to have 3 nuclei but only two of them are aromatic. Normally, the aromatic group will contain only carbon atoms in the aromatic nuclei per se, although other non-aromatic substitution, such as in particular short chain alkyl substitution can also be present. Thus methyl, ethyl, propyl, and t-butyl groups, for instance, can be present on the aromatic groups, even though such groups may not be explicitly represented in structures set forth herein.

This first reactant, being a hydroxy aromatic compound, can be referred to as a phenol. When the term "phenol" is used herein, however, it is to be understood, depending on the context, that this term need not limit the aromatic group of the phenol to benzene, although benzene may be the preferred aromatic group. Rather, the term is to be understood in its broader sense to include, depending on the context, for example, substituted phenols, hydroxy naphthalenes, and the like. Thus, the aromatic group of a "phenol" can be mononuclear or polynuclear, substituted, and can include other types of aromatic groups as well.

Specific examples of single ring aromatic moieties are the following:

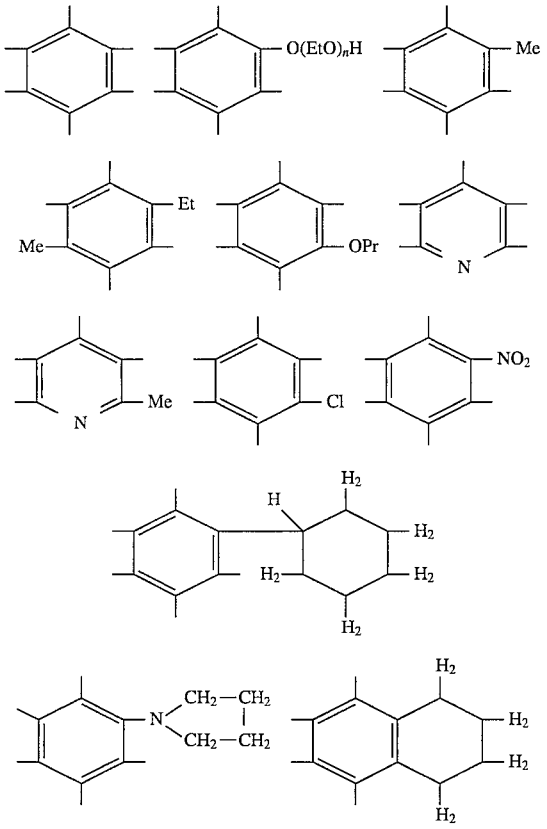

etc., wherein Me is methyl, Et is ethyl or ethylene, as appropriate, and Pr is n-propyl.

Specific examples of fused ring aromatic moieties are:

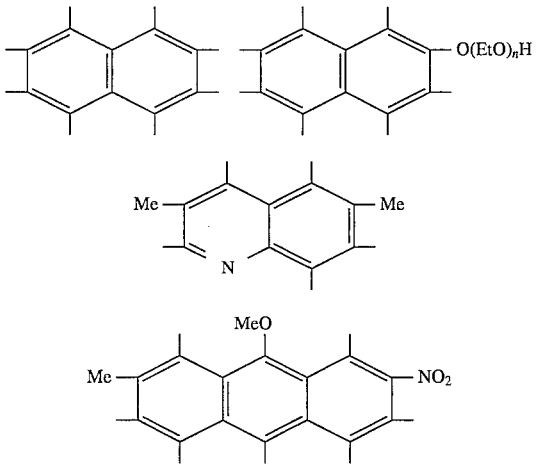

-continued

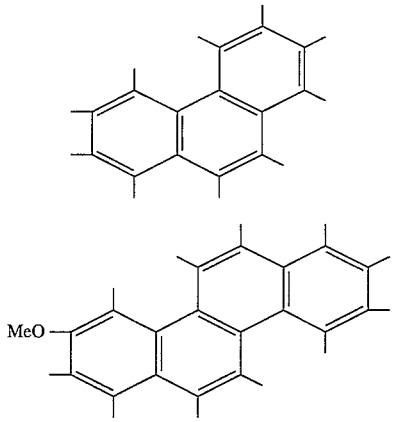

etc.

When the aromatic moiety is a linked polynuclear aromatic moiety, it can be represented by the general formula $$ar(—L—ar—)_w$$

wherein w is an integer of 1 to about 20, each ar is a single ring or a fused ring aromatic nucleus of 4 to about 12 carbon atoms and each L is independently selected from the group consisting of carbon-to-carbon single bonds between ar nuclei, ether linkages (e.g. —O—), keto linkages (e.g., $$-\overset{O}{\overset{\|}{C}}-),$$

sulfide linkages (e.g., —S—), polysulfide linkages of 2 to 6 sulfur atoms(e.g., $—S—_{2-6}$), sulfinyl linkages (e.g., —S(O)—), sulfonyl linkages (e.g., $—S(O)_2—$), lower alkylene linkages (e.g., $—CH_2—$, $—CH_2—CH_2—$, $$-CH_2-\underset{\underset{R^o}{|}}{CH}-)$$

mono(lower alkyl)-methylene linkages (e.g., —CHR°—), di(lower alkyl)-methylene linkages (e.g., $—CR°_2—$), lower alkylene ether linkages (e.g., $—CH_2O—$, $—CH_2O—CH_2—$, $—CH_2—CH_2O—$, $—CH_2CH_2OCH_2CH_2—$, $$-CH_2\underset{\underset{R^o}{|}}{C}HO\underset{\underset{R^o}{|}}{C}H_2CH-,\ -CH_2\underset{\underset{R^o}{|}}{C}HO\underset{\underset{R^o}{|}}{C}HCH_2-,\ \text{etc.}),$$

lower alkylene sulfide linkages (e.g., wherein one or more —O—'s in the lower alkylene linkages is replaced with a S atom), lower alkylene polysulfide linkages (e.g., wherein one or more —O— is replaced with a $—S_{2-6}—$ group), amino linkages (e.g., $$-\underset{\underset{H}{|}}{N}-,\ -\underset{\underset{R^o}{|}}{N}-,$$

$—CH_2N—$, $—CH_2NCH_2—$, —alk—N—, where alk is lower alkylene, etc.), polyamino linkages (e.g., $—N(alkN)_{1-10}$,where the unsatisfied free N valences are taken up with H atoms or R° groups), linkages derived from oxo- or keto-carboxylic acids (e.g.)

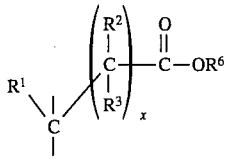

Wherein each $R^1$, $R^2$ and $R^3$ is independently hydrocarbyl, preferably alkyl or alkenyl, most preferably lower alkyl, or H, $R^6$ is H or an alkyl group and x is an integer ranging from 0 to about 8, and mixtures of such bridging linkages (each R° being a lower alkyl group).

Specific example of linked moieties are:

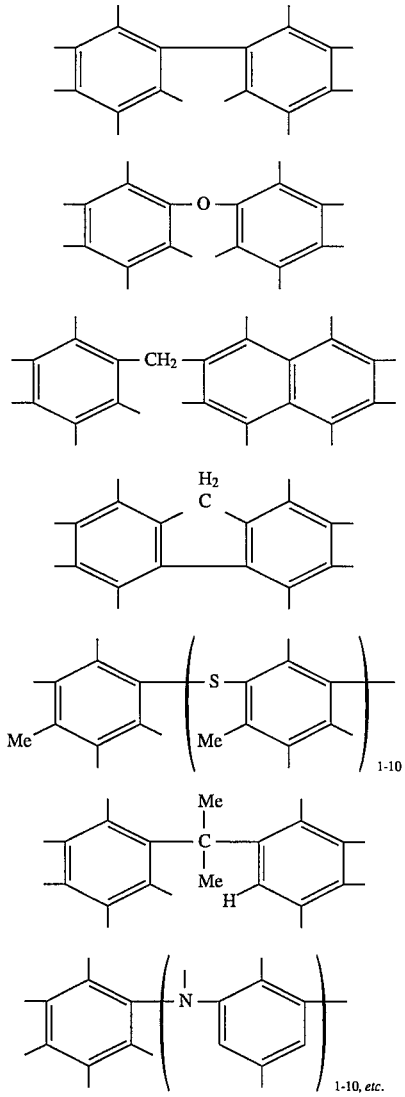

Usually all of these Ar groups have no substituents except for those specifically named. For such reasons as cost, availability, performance, etc., the aromatic group is normally a benzene nucleus, a lower alkylene bridged benzene nucleus, or a naphthalene nucleus. Most preferably the aromatic group is a benzene nucleus.

This first reactant is a hydroxyaromatic compound, that is, a compound in which at least one hydroxy group is directly attached to an aromatic ring. The number of hydroxy groups per aromatic group will vary from 1 up to the maximum number of such groups that the hydrocarbyl-substituted aromatic moiety can accommodate while still retaining at least one, and preferably at least two, positions, at least some of which are preferably adjacent (ortho) to a hydroxy group, which are suitable for further reaction by condensation with aldehydes (described in detail below). Thus most of the molecules of the reactant will have at least two unsubstituted positions. Suitable materials can include, then, hydrocarbyl-substituted catechols, resorcinols, hydroquinones, and even pyrogallols and phloroglucinols. Most commonly each aromatic nucleus, however, will bear one hydroxyl group and, in the preferred case when a hydrocarbyl substituted phenol is employed, the material will contain one benzene nucleus and one hydroxyl group. Of course, a small fraction of the aromatic reactant molecules may contain zero hydroxyl substituents. For instance, a minor amount of non-hydroxy materials may be present as an impurity. However, this does not defeat the spirit of the inventions, so long as the starting material is functional and contains, typically, at least one hydroxyl group per molecule.

The hydroxyaromatic reactant is similarly characterized in that at least some of the units of which are hydrocarbyl substituted. Typically most or all of the molecules are hydrocarbyl substituted, so as to provide the desired hydrocarbon-solubility to the product molecules. If the hydroxyaromatic compound comprises bridged ring units, then substantially all such units are hydroxyl-and hydrocarbyl-substituted; that is, each ring unit which is linked by a bridging group to another ring unit will have at least one hydroxyl substituent and at least one hydrocarbyl substituent. The term "hydrocarbyl substituent" or "hydrocarbyl group" is used herein in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Preferably the hydrocarbyl group is an alkyl group. Typically the alkyl group will contain 8 to 400 carbon atoms, preferably 12 to 100 carbon atoms. Alternatively expressed, the alkyl groups can have a number average molecular weight of 150 to 2000, preferably 200 to 1200.

When the hydrocarbyl is an alkyl or alkenyl group having 8 to 28 carbon atoms, it is typically derived from the corresponding olefin; for example, a dodecyl group is derived from dodecene, an octyl group is derived from octene, etc. When the hydrocarbyl group is a hydrocarbyl group having at least about 30 carbon atoms, it is frequently an aliphatic group made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-mono olefins such as homopolymers of ethylene. These aliphatic hydrocarbyl groups can also be derived from halogenated (e.g., chlorinated or brominated) analogs of such homo- or interpolymers. Such groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the hydrocarbyl groups may be reduced or eliminated by hydrogenation according to procedures known in the art.

In one preferred embodiment, at least one hydrocarbyl group is derived from polybutene. In another preferred embodiment, the hydrocarbyl group is derived from polypropylene. In a further preferred embodiment, the hydrocarbyl substituent is a propylene tetramer.

In yet another embodiment, the alkylphenol component is a mixture of alkyl phenols, wherein some molecules contain alkyl substituents of 4 to 8 carbon atoms, such as a tertiary-alkyl (e.g., t-butyl) group, and some molecules contain alkyl substituents of 9 to 400 carbon atoms.

More than one such hydrocarbyl group can be present, but usually no more than 2 or 3 are present for each aromatic nucleus in the aromatic group.

The attachment of a hydrocarbyl group to the aromatic moiety of the first reactant of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "Kirk-Othmer Encyclopedia of Chemical Technology", Third Edition, Vol. 2, pages 65–66, Interscience Publishers, a division of John Wiley and Company, N.Y. Other equally appropriate and convenient techniques for attaching the hydrocarbon-based group to the aromatic moiety will occur readily to those skilled in the art.

Specific illustrative examples of hydrocarbyl-substituted hydroxyaromatic compounds include hydrocarbon substituted-phenol, naphthol, 2,2'-dihydroxybiphenyl, 4,4-dihydroxybiphenyl, 3-hydroxyanthracene, 1,2,10-anthracenetriol, and resorcinol; 2-t-butyl phenol, 4-t-butyl phenol, 2,6-di-t-butyl phenol, octyl phenol, cresols, propylene tetramer-substituted phenol, propylene oligomer (MW 300–800)-substituted phenol, polybutene ($M_n$ about 1000) substituted phenol, substituted naphthols corresponding to the above exemplified phenols, methylene-bis-phenol, bis-(4-hydroxyphenyl)-2,2-propane, and hydrocarbon substituted bis-phenols wherein the hydrocarbon substituents have at least 8 carbon atoms, for example, octyl, dodecyl, oleyl, polybutenyl, etc., sulfide-and polysulfide-linked analogues of any of the above, alkoxylated derivatives of any of the above hydroxy aromatic compounds, etc.

The composition of matter of the present invention is the reaction product of the above-described substituted hydroxyaromatic compound with each of two classes of carbonyl compounds. The expression "carbonyl compound," as used herein, includes aldehydes and ketones. The first carbonyl compound component is a carboxy-substituted carbonyl compound. This material can be, in a typical embodiment, expressed by the formula $$R^1CO(CR^2R^3)_nCOOR^6$$

wherein $R^1$, $R^2$ and $R^3$ are independently H or a hydrocarbyl group, $R^6$ is H or an alkyl group, and n is an integer ranging from 0 to 8, preferably 0 to 5.

When $R^6$ is an alkyl group (i.e., the compound is an ester-aldehyde) it is preferably a lower alkyl group, most preferably, ethyl or methyl. When $R^1$ is H, as is preferred, the aldehyde moiety of the above material may be hydrated, the hydrate serving a source of the carboxy-substituted aldehyde. For example, glyoxylic acid is readily available commercially as the hydrate having the formula $$(HO)_2CH—COOH.$$

Water of hydration as well as any water generated by the condensation reaction is preferably removed during the course of the reaction.

Examples of materials which can suitably serve as the carboxy-substituted carbonyl compound include glyoxylic acid and other ω-oxoalkanoic acids, keto alkanoic acids such as pyruvic acid, levulinic acid, ketovaleric acids, and ketobutyric acids. Other carboxy substituents include esters such as ethyl-acetoacetate, amides, acyl halides, and salts.

The second class of carbonyl compound reactants in the present invention is the class of carbonyl compounds other than carboxy-substituted carbonyl compounds. Suitable compounds have the general formula RC(O)R', where R and R' are each independently hydrogen or a hydrocarbyl group, as described above, although R can include other functional groups (other than carboxy groups) which do not interfere with the condensation reaction (described below) of the compound with the hydroxyaromatic compound. This compound preferably contains 1 to 12 carbon atoms. Suitable aldehydes include formaldehyde, acetaldehyde, propionaldehyde, butyraldehyde, isobutyraldehyde, pentanaldehyde, caproaldehyde, benzaldehyde, and higher aldehydes. Other aldehydes include dialdehydes, although monoaldehydes are generally preferred. The most preferred aldehyde is formaldehyde, which can be supplied as a solution, but is more commonly used in the polymeric form, as paraformaldehyde. Paraformaldehyde may be considered a reactive equivalent of, or a source for, an aldehyde. Other reactive equivalents may include hydrates or cyclic trimers of aldehydes. Suitable ketones include acetone, butanone, and other ketones where preferably one of the hydrocarbyl groups is methyl. More than one species of each class of carbonyl compound can be employed; for instance, adducts including formaldehyde, glyoxal, and glyoxylic acid are encompassed.

The composition of the present invention is generally a polymeric or oligomeric species which is prepared by reacting the three above-named components under condensing conditions. The hydroxyaromatic component and the aldehyde components (together) are generally reacted in molar ratios to provide a condensate of approximately a 1:1 aromatic:aldehyde composition, although deviations from this ratio may be employed if desired. Typically the ratio of the hydroxyaromatic compound:carboxy-substituted aldehyde:other aldehyde is 2:(0.1 to 1.5):(1.9 to 0.5). Preferably the ratio is 2:(0.8 to 1.1):(1.2 to 0.9). The amounts of the materials fed to the reaction mixture will normally approximate these ratios, although corrections may need to be made to compensate for greater or lesser reactivity of one component or another, in order to arrive at a reaction product with the desired ratio of monomers. Such corrections will be apparent to the person skilled in the art.

The conditions under which the condensation reaction of the components is conducted are well-known condensing conditions. For example, the required amounts of reactants can be combined in a suitable reactor, optionally with a basic or, preferably, acidic catalyst and an inert solvent, and heated with removal of water of condensation. The reaction temperature can be from room temperature up to 250° C., depending on the solvents and reactivity of the starting materials and the temperature employed; typically temperatures of 100° to 200° C. are employed (to permit facile removal of water by distillation) or, preferably, 120°–180° C. The reaction will be continued until the expected quantity of water of condensation is removed, typically for 30 minutes to 24 hours, more commonly 2 to 8 hours. The reaction product can be isolated by conventional means.

While the three reactants can be condensed simultaneously to form the product, it is also possible to conduct the reaction sequentially, whereby the hydrocarbyl phenol is reacted first with either the carboxy-substituted carbonyl-containing material and thereafter with the unsubstituted material, or vice versa.

The product described above, as well as the derivatives described in greater detail below, can be prepared, if desired, by processes which are substantially or entirely free from the use of chlorine or chloride. The result can be a low chlorine or chlorine-free additive or lubricant, which is desirable in view of current environmental concerns.

It is speculated that the initially formed product contains hydroxyaromatic monomers adjacent to monomers derived from the condensation of the carboxy-substituted carbonyl compound, wherein the carboxy group is in an open or non-ring structure. Particularly when the carboxy group is in the form of the acid, this initial material will generally be converted, optionally upon further heating, to the closed, lactone, or ring structure. The resulting product will typically comprise at least some molecules containing the structures:

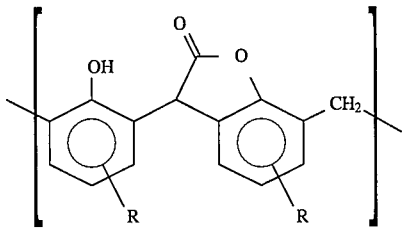

or

-continued

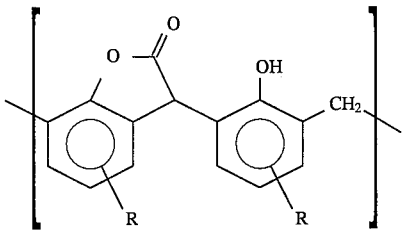

where, for purposes of illustration, the hydrocarbyl-substituted hydroxyaromatic moiety is derived from hydrocarbyl-substituted phenol, the carboxyl-substituted aldehyde moiety is derived from glyoxylic acid, and the other aldehyde moiety is derived from formaldehyde. In a preferred embodiment, at least some molecules of the composition will contain one or both of the structures illustrated above. In the above structures, the —$CH_2$— group shown on the right will normally be linked to another phenol moiety, which may be further similarly substituted with a bridging group; or it may be linked to a phenol moiety which does not have further bridging functionality, thus terminating the molecule. The unattached bond shown on the left of the above structures may be linked to another bridging group; alternatively it may represent the termination of the molecule by attachment to a hydrogen atom, hydrocarbyl group, or other non-bridging group. The above structures are not intended to suggest that all the bridging groups are necessarily positioned ortho to the oxygen atoms of the hydroxy or lactone groups. Depending on reaction conditions, it is also possible that some of the molecules can contain hydroxymethyl end groups (derived from formaldehyde) or even ether linkages within the chain. The preferred material is a substantially alternating oligomer with a structure similar to that illustrated above. By "substantially alternating" is meant that the phenol moieties alternate with carbonyl-derived moieties, whether of the carboxy-substituted or unsubstituted type. The different types of carbonyl-derived moieties may appear in a regularly alternating or in a random sequence (separated, in either case, by phenolic monomers), depending on their relative reactivities and the reaction conditions.

The length of the chain of monomers produced will depend on such reaction conditions as the relative ratios of the monomers employed. The minimum chain length for an appropriate condensation product would include 2 hydroxyaromatic units; the maximum chain length is not well defined and would be determined by considerations of suitable solubility in an oil medium. Typically the chain of the product will contain 3 to 20 hydroxyaromatic units, preferably 4 to 10 such units, and more preferably 5 to 8 such units.

The following Examples illustrate preparation of the condensation product of the present invention:

EXAMPLE 1

Into a 12 L flask is charged 2252 g (2.0 moles) polyisobutenyl ($M_n$=950) substituted phenol, 296 g (2.0 moles) 50% aqueous glyoxylic acid, 60.0 g paraformaldehyde, and 4.5 g methanesulfonic acid (70%, aqueous), along with 700 g stock diluent oil. The mixture is heated with stirring to 130° C. over a period of 4 hours, collecting evolved water. Thereafter the mixture is heated to 150° C. and maintained at that temperature for 2 hours, then cooled to room temperature and permitted to stand overnight. The mixture is again heated to 150° C. and maintained at temperature for 5 hours, whereafter it is cooled to 125° C. During the course of the aforementioned heatings, water is collected, amounting to about 215 g. An additional amount of 894 g. diluent oil is added and the mixture is heated to 160° C. at 6.0 kPa (45 mm Hg) to remove remaining volatiles. The mixture is cooled and let stand, then thereafter heated to 150° C. and filtered through a filter aid. The filtrate contains the desired product in diluent oil. The product exhibits an absorption at 1780 $cm^{-1}$ in the infrared spectrum.

EXAMPLES 2–9

Example 1 is repeated except the amounts of the alkylphenol, the glyoxylic acid, and the formaldehyde, in grams, are varied as shown in the following table. The additional diluent oil, added in Example 1, is not added in these examples.

| Ex. | Alkyl phenol | Glyoxylic acid | Formaldehyde | Total |
|---|---|---|---|---|
| 2 | 5909.4 | 382.6 | 80.8 | 6352.8 |
| 3 | 4991.2 | 1226 | 136.6 | 6352.8 |
| 4 | 5590.3 | 686 | 76.5 | 6352.8 |
| 5 | 4886.1 | 1199.3 | 267.4 | 6352.8 |
| 6 | 5835.1 | 358 | 159.7 | 6352.8 |
| 7 | 5395.4 | 662.1 | 295.3 | 6352.8 |
| 8 | 5523.8 | 667.9 | 151.1 | 6342.8 |
| 9 | 5523.8 | 677.9 | 151.1 | 6352.8 |

EXAMPLE 10

A 1-L four-necked, round-bottom flask is equipped with a stirrer, thermowell, nitrogen inlet tube, Dean-Stark trap, and Friedrich's condenser, and is charged with 360.2 g of $C_{24-28}$ alkyl substituted phenol. The flask is heated to 80° C. with stirring under a nitrogen flow of 17 L/hr (0.6 std. $ft^3$/hr), and glyoxylic acid, 18.0 g of a 50 weight percent aqueous material, paraformaldehyde, 18 g of 91% active material, and thereafter 0.70 g of 70 wt. % aqueous methanesulfonic acid and 40 g o-xylene. The mixture is heated to 160° C. over 3.0 hours and maintained at 160° C. for 3.5 hours. During the course of heating, 23 mL water is removed. An additional portion of 300 g o-xylene is added to the mixture at 160° C., then 20 g filter aid. The mixture is cooled to 80° C. and filtered through a glass filter pad. The filtrate is the product, dissolved in xylene.

EXAMPLE 11

Into a 5 L 4-necked flask is placed 1200 g polyisobutenyl($M_n$=1950) phenol. The reactant is heated with stirring to 200° C. and stripped for 4 hours at 1.3 kPa (10 mm Hg). After cooling overnight, 84.6 g glyoxylic acid (50% aqueous) and 18.9 g paraformaldehyde (94%), 1.3 g methanesulfonic acid (70% aqueous) and 410 g diluent oil are added. The mixture is heated to 120° C. over 1 hour and maintained at this temperature for 2 additional hours, collecting water in a Dean-Stark trap. The mixture is further heated over 45 minutes to 150° C. and maintained at temperature for 5 hours, further collecting water. After cooling overnight, the mixture is stripped at 150° C. at 3.3 kPa (25 mm Hg) for ½ hour, then filtered using filter aid. The filtrate is the product.

EXAMPLE 12

Into a 5-L 4-necked flask are charged 1310 g propylene tetramer-substituted phenol, 740 g 50% aqueous glyoxylic acid, 150 g paraformaldehyde, and 4.2 g 70% aqueous methanesulfonic acid. The mixture is heated under nitrogen, over 2 hours, to 120° C., collecting water of condensation. the temperature is increased to 130° C. and maintained at that temperature for 4 hours, while continuing to collect water. The mixture is cooled and let stand overnight. To the reaction mixture is added 580 g aromatic hydrocarbon solvent, the mixture is heated to 130° C. and maintained at temperature for 6 hours. The next day the heating is continued, at 160° C., for 7 hours, replacing the solvent as it distilled out. The mixture, at 145° C., is filtered through filter aid (FAX-6™) to obtain the product, in solvent.

EXAMPLE 13

A 1-L, four-necked, round-bottom flask is equipped with a stirrer, a thermowell, a nitrogen purge tube supplying nitrogen at 3 L/hr (0.1 std. $ft^3$/hr), a Dean-Stark trap, and a Friedrich's condenser. The flask is charged with 384.6 g of $C_{20-24}$ alkyl-substituted phenol, 77 g aromatic solvent (boiling range about 179° C.), and 21.05 g paraformaldehyde (91%). Upon heating the mixture to 75° C., 0.04 g methanesulfonic acid (70%, aqueous) is added. The mixture is further heated to 100° C. and thereafter heated over about 2.5 hours to 115° C., while collecting and removing water from the reaction. The mixture is allowed to cool to 105° C. and glyoxylic acid, 31.2 g of 50% aqueous material, is added. The mixture is heated to 115° C., then heated graduaully to 160° C. over 3 hours and maintained at that temperature for an additional 1 hour. Additional water is collected and removed (along with about 11.5 g solvent). Additional aromatic solvent, 340 g, is added. The mixture is filtered through a glass microporous filter to remove a small amount of dark resin. The product filtrate is a red oil.

EXAMPLE 14

A 1-L four-necked, round-bottom flask is equipped as in Example 13, with nitrogen flow of 8–22 L/hr (0.3–0.8 std. $ft^3$/hr). The flask is charged with 384.6 g of $C_{20-24}$ alkyl-substituted phenol and 77 g aromatic solvent. Glyoxylic acid (31.2 g, 50 weight percent, aqueous) is charged over a 5-minute period at 50°–60° C., and 0.04 g methanesulfonic acid (70 wt. %, aqueous) is added at 70° C. The mixture is heated to 140° C. for 0.25 hours, thereafter cooled to 93° C., and 21.05 g paraformaldehyde (91%) is added. The reaction mixture is heated gradually to 160°–162° C. over about 2 hours and maintained at that temperature for 1.5 hours. During this time water is collected. The reaction is cooled to 120° C., an additional 340 g aromatic solvent is added, and the resulting mixture, an orange oil, is poured into a jar for storage.

The reaction product, prepared as described in detail above, can be used without further reaction as lubricant additives, fuel additives, 2-cycle oil additives, cold-flow modifiers, pour point modifiers for lubricating oils, asphaltene suspension aids, crosslinking agents for coatings, insulating coatings for electrical equipment, additives for resin manufacture, UV inhibitors for plastics, and ozone or oxidation inhibitors. When the reaction product is employed as a pour point depressant, the preferred alkyl chain lengths will be 8 to 50 carbon atoms, more preferably 16 to 30 carbon atoms. The specific chain length can be adjusted to obtain the optimum pour point depressant effect, as measured by ASTM D 97. The material will be present in an amount suitable to produce the desired reduction in pour point of a wax-containing hydrocarbon liquid; the specific amount will vary with the chemical nature of the paraffinic liquid in which it is to be employed. Effective amounts are typically 100 to 2000 parts per million by weight of the final composition, preferably 200 to 400 parts per million. When used as a concentrate, the absolute amount of the material will be increased accordingly.

EXAMPLE 15

Two crude oils, shown in the following table, are each treated with 500 ppm of the product of Example 10. Their pour points are reduced as indicated.

| Crude oil | Pour point, °C., untreated | Pour point, °C., treated |
|---|---|---|
| (A) North Sea crude | −7 | −15 |
| (B) Gulf of Mexico crude | 23 | 10 |

Alternatively, the reaction product can be further reacted with other materials to provide useful additives. For example, the reaction product of this invention can be reacted with ammonia or amines to provide, for example, the corresponding amides or amine salts. Amines are well known chemicals and include primary, secondary, or tertiary amines, although for ease of reactivity, secondary and, in particular, primary amines are preferred. Amines, including tertiary amines, containing at least one hydroxy group can also be employed.

The amines can be monoamines or polyamines. They can be aliphatic, cycloaliphatic, aromatic, or heterocyclic, including aliphatic-substituted cycloaliphatic, aliphatic-substituted aromatic, aliphatic-substituted heterocyclic, cyloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic-substituted alicyclic, and heterocyclic-substituted aromatic amines, and can be saturated or unsaturated. The amines can also contain non-hydrocarbon substituents or groups as long as these groups do not significantly interfere with the reaction of the amines with the initial product of this invention. Such non-hydrocarbon substituents or groups include lower alkoxy, lower alkyl mercapto, nitro, interrupting groups such as —O— and —S— (e.g., as in such groups as $—CH_2CH_2—X—CH_2CH_2$ where X is —O— or —S—).

With the exception of the branched polyalkylene polyamines, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic group can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, and octadecylamine. Examples of cycloaliphatic-substituted aliphatic amines, aromatic-substituted aliphatic amines, and heterocyclic-substituted aliphatic amines, include 2-(cyclohexyl)ethylamine, benzylamine, phenethylamine, and 3-(furylpropyl)-amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl)amine, naphthylamine, and N,N-di(butyl)aniline. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

Other amines include aminopyridines (2- or 4-substituted), hydroxylamine, guanidine, aminoguanidine, aminotriazole, hydrzaine, and substituted hydrazines such as methylhydrazine ($CH_3NH—NH_2$).

Examples of the polyamines include alkylene polyamines, hydroxy containing polyamines, arylpolyamines, and heterocyclic polyamines.

Alkylene polyamines are represented by the formula

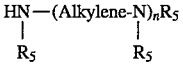

wherein n has an average value from 1, or about 2 to about 10, or to about 7, or to about 5, and the "Alkylene" group has from 1, or about 2 to about 10, or to about 6, or to about 4 carbon atoms. Each $R_5$ is independently hydrogen or an aliphatic or hydroxy-substituted aliphatic group of up to about 30 carbon atoms.

Such alkylenepolyamines include methylenepolyamines, ethylenepolyamines, butylenepolyamines, propylenepolyamines, pentylenepolyamines, etc. The higher homologs and related heterocyclic amines such as piperazines and N-aminoalkyl-substituted piperazines are also included. Specific examples of such polyamines are ethylenediamine, diethylenetriamine (DETA), triethylenetetramine (TETA), tris-(2-aminoethyl)amine, propylenediamine, trimethylenediamine, tripropylenetetramine, tetraethylenepentamine, hexaethyleneheptamine, pentaethylenehexamine, etc.

Higher homologs obtained by condensing two or more of the above-noted alkylene amines are similarly useful as are mixtures of two or more of the aforedescribed polyamines. For example, the condensation product of one or more of the above polyamines with trishydroxymethylaminomethane is useful.

Ethylenepoiyamines, such as those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylenepolyamines including cyclic condensation products such as the aforedescribed piperazines. Ethylenepolyamine mixtures are useful.

Other useful types of polyamine mixtures are those resulting from stripping of the above-described polyamine mixtures to leave as residue what is often termed "polyamine bottoms" or "amine bottoms." In general, alkylenepolyamines bottoms can be characterized as having less than two, usually less than 1% (by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentamine and 76.61% pentaethylenehexamine and higher (by weight). These alkylenepolyamine bottoms include cyclic condensation products such as piperazine and higher analogs of diethylenetriamine, triethylenetetramine and the like. These amine bottoms can be reacted alone with the carboxy-containing reaction product of the present invention, or they can be used with other amines, polyamines, or mixtures thereof.

In another embodiment, the polyamines are hydroxy-containing polyamines. Hydroxy-containing polyamine analogs of hydroxymonoamines, particularly alkoxylated alkylenepolyamines (e.g., N,N(diethanol)ethyl-enediamine) may also be used. Such polyamines may be made by reacting the above-described alkylenepolyamines with one or more alkylene oxides. Similar alkylene oxide-alkanolamine reaction products may also be used such as the products made by reacting primary, secondary or tertiary alkanolamines with ethylene, propylene or higher epoxides in a 1:1 to 1:2 molar ratio. Reactant ratios and temperatures for carrying out such reactions are known to those skilled in the art.

Specific examples of alkoxylated alkylene polyamines include N-(2-hydroxyethyl)ethylenediamine, N,N-bis(2-hydroxyethyl)ethylenediamine, 1-(2-hydroxyethyl)piperazine, mono(hydroxypropyl)substituted tetraethylenepentamine, N-(3-hydroxybutyl)tetramethylene diamine, etc. Higher homologs obtained by condensation of the above-illustrated hydroxy-containing polyamines through amino groups or through hydroxy groups are likewise useful. Mixtures of two or more of any of the aforesaid polyamines are also useful.

In another embodiment, the amine is a heterocyclic polyamine. The heterocyclic polyamines include aziridines, azetidines, azolidines, pyridines, pyrroles, indoles, piperidines, imidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethyl-piperazine. Hydroxy heterocyclic polyamines are also useful. Examples include N-(2-hydroxyethyl)cyclohexylamine, 3-hydroxycyclopentylamine, para-hydroxyaniline, N-hydroxyethylpiperazine, and the like.

The extent of the reaction of the initial product of the present invention with an amine can be expressed in terms of the ratio of C=O groups to N atoms in the condensation product. The materials of the present invention preferably have a C=O:N ratio of 1:1 to 1:5, indicating that an amount of amine can be employed which provides up to about 5 times as many nitrogen atoms as will react with the acid (or equivalent) functionality of the initial product. In another preferred embodiment, the C=O:N ratio is 1.5 to 2.0.

The following are examples of the reaction with amines:

EXAMPLE 16

To 1-L, 4-necked round bottom flask equipped with stirrer and nitrogen inlet is charged 500 g (0.22 equivalents based on carboxylate groups present, as determined by saponification number) of the product of Example 1 (including the diluent oil present in the product), 14.7 g (0.37 equivalents based on nitrogen atoms) of polyethyleneamine bottoms (from Dow), and 9.8 g diluent oil. The mixture is heated to 160° C. with stirring under nitrogen, and maintained at this temperature for 6 hours. The mixture is cooled to 140° C. and filtered over filter aid. The filtrate is the product, in oil. The product exhibits an absorption at 1650 $cm^{-1}$ in the infrared.

EXAMPLE 17

Example 16 is substantially repeated except that in place of the above amine there is employed 15.0 g (0.37 equivalents based on nitrogen atoms) of polyethyleneamine bottoms from Union Carbide. The product exhibits an absorption at 1655 $cm^{-1}$ in the infrared.

EXAMPLE 18

To a 1-L four-necked flask is added 245.0 g of the adduct of $C_{24-28}$ alkylphenol, glyoxylic acid, and formaldehyde, 64.5 g of aminoethylpiperazine, and 132.6 g of aromatic hydrocarbon solvent. The materials are heated to 145° C. with stirring, and maintained at this temperature for 6 hours. The mixture is cooled and let stand overnight. Upon reheating to 140° C., the mixture is filtered through filter aid to isolate the product as the filtrate.

EXAMPLE 19

Example 18 is repeated except that in place of the aminoethylpiperazine there is used 52.0 g aminoethylethanolamine.

The initial reaction product of the present invention can, likewise, be reacted with polyols, to form, for example, the corresponding esters. Polyols, otherwise referred to as polyalcohols or polyhydroxy compounds, are aliphatic or aromatic structures with a plurality of alcoholic OH groups. Polyhydroxy compounds may be represented by the general formula $R(OH)_n$ wherein R is a hydrocarbyl group and n is at least 2. The hydrocarbyl group will preferably contain 4 to 20 or more carbon atoms, and the hydrocarbyl group may also contain one or more nitrogen and/or oxygen atoms. The polyhydroxy compounds generally will contain from 2 to 10 hydroxyl groups and more preferably from 3 to 10 hydroxyl groups.

As with the amine reactant, the alcohols can be aliphatic, cycloaliphatic, aromatic, and heterocyclic, including aliphatic-substituted cycloaliphatic alcohol, aliphatic-substituted aromatic alcohols, aliphatic-substituted heterocyclic alcohols, cycloaliphatic-substituted aliphatic alcohols, cycloaliphatic substituted aromatic alcohols, cycloaliphatic-substituted heterocyclic alcohols, heterocy clic-substituted aliphatic alcohols, and heterocyclic-substituted aromatic alcohols. The alcohols can contain non-hydrocarbon substituents of the same type mentioned with respect to the amines above, that is, non-hydrocarbon substituents which do not interfere with the reaction of the alcohols with the initial product of the invention.

Specific examples of polyhydroxy compounds useful in the present invention include ethylene glycol, diethylene glycol, triethylene glycol, propylene glycol, dipropylene glycol, glycerol, neopentyl glycol, 1,2-, 1,3- and 1,4-butanediols, pentaerythritol, dipentaerythritol, tripentaerythritol, triglycerol, trimethylolpropane, di-trimethylolpropane, sorbitol, inositol, hexaglycerol, 2,2,4-trimethyl-1,3-pentanediol, catechol, resorcinol, hydroquinone, etc. The mixtures of any of the above polyhydroxy compounds can also be utilized. These and other polyols are well-known chemical materials which are generally commercially available.

The number of carbon atoms and number of hydroxyl groups contained in the polyhydroxy compound used to form the carboxylic esters may vary over a wide range.

Examples of the reaction with polyols include the following:

EXAMPLE 20

A mixture of 1031 parts of the product of Example 1 (an oligomeric lactone), 500 parts of poly(butylene oxide) ($M_n$= 1000, methanol initiated) in the presence of 1.5 parts 70% aqueous methanesulfonic acid is heated for 10 hours at 160° C. The reaction mixture is cooled to 100° C. and filtered through 100 parts diatomaceous filter aid to yield the product.

EXAMPLE 21

To a 1-L, 4-necked, round bottom flask equipped with stirrer, thermo-well, nitrogen purge tube, Dean-Stark trap, and a Friedrich's condenser, is added 498.2 g of $C_{16-18}$ alkyl substituted phenol, 99.5 g commercial aromatic solvent (boiling point about 179° C.), 33.0 g paraformaldehyde (91%), and, upon heating to 70° C., 0.05 g methanesulfonic acid catalyst (70%, aqueous) and 2 drops silicone antifoam solution. The mixture is heated from 93° C. to 104° C. over 1 hour, maintained at 104°–105° C. for 2.5 hours, further heated to 120° C. over 1 hour (collecting 19 mL water), then cooled to 90° C. Glyoxylic acid, 49.0 g (50%, aqueous) is charged. The mixture is heated to 115°–120° C. and maintained at temperature for 3 hours, with collection of water, thereafter heated from 120° C. to 160° C. over 1 hour and maintained at 160° C. for 1 hour. A total of 28.5 g water are removed. The mixture is cooled overnight and a portion of the intermediate (144 g) is removed for separate study. The intermediate is a light, slightly viscous, red orange oil.

The intermediate is heated to 35° C. in the same vessel. To the mixture is added 29.0 g tris(hydroxymethyl)aminomethane ($H_2N—C(CH_2OH)_3$). The mixture effervesces and thickens somewhat; the mixture is heated to 120° C. over 3.0 hours, then heated to 160° C. over 1.5 hours and maintained at 160°–162° C. for 2.4 hours. A total of 5 mL of water is removed during the reaction, as well as 9.7 g of a light hydrocarbon distillate. The mixture is cooled to 120° C. and filtered through a microfibrous glass filter pad to yield the product as a red viscous oil.

The polyhydroxy compound may contain one or more oxyalkylene groups, and, thus, the polyhydroxy compounds include compounds such as polyetherpolyols, also referred to as polyol ethers. Included are those polyols prepared by the reaction of a hydroxy-substituted compound, $R_4—(OH)_q$ with an alkylene oxide,

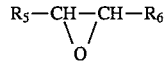

$R_5$ being a lower alkyl group of up to four carbon atoms, $R_6$ being a H or the same as $R_5$, provided that the alkylene oxide normally does not contain more than ten carbon atoms. The compound $R_4—(OH)_q$ can be any of the polyols described above. The polyol ether can have a number average molecular weight of 1000 to 10,000, preferably 2000 to 7000. Both homopolymers and copolymers can be used.

The hydroxy compounds used in the preparation of the carboxylic esters products also may contain one or more nitrogen atoms. These reactants would also be referred to as amino alcohols. For example, the amino alcohol can be an a alkanolamine containing from 3 to 6 hydroxyl groups. In one preferred embodiment, the alkanolamine contains at least two hydroxyl groups and more preferably at least three hydroxyl groups. Examples of suitable amino alcohols are the N-(hydroxy-lower alkyl)amines and polyamines such as 2-hydroxyethylamine, 3-hydroxylbutylamine, di-(2-hydroxyethyl)amine, tri-(2hydroxyethyl)amine, D-(2-hydroxypropyl)amine, N,N,N'-tri(2-hydroxyethyl)-ethylenediamine, 2-amino-1-butanol, 2-amine-2-methyl-1-propanol, and the like.

Additionally, the initial product of this invention can be reacted with mixtures of any of the above classes or types of materials. For additional examples of amino and of hydroxy-containing materials which are suitable for reaction with an acylating agent such as the initial product of this invention, attention is directed to U.S. Pat. No. 4,234,435, Meinhardt et al.

The products described above, with amines, alcohols, or mixtures of such materials, are useful as dispersants for fuels and lubricants for internal combustion engines, as well as dispersant-detergents for such applications.

The initial product of the present invention, being in the form of an acid, ester, lactone, or equivalent material, can also be reacted with one or more basic metal compounds to form the metal salt. (Amine salts, also included, have been described above.) The salts can be either neutral salts or overbased salts. Overbased materials are single phase, homogeneous, generally Newtonian systems characterized by a metal content in excess of that which would be present according to the stoichiometry of the metal and the particular acidic organic compound reacted with the metal.

The amount of metal in an ordinary or overbased salt is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of at least 1.1, preferably at least 1.3, more preferably at least 1.5, preferably up to 40, more preferably 20, and even more preferably 10. A preferred metal ratio is 1.5–6.

The basicity of the overbased materials of the present invention generally is expressed in terms of a total base number. A total base number is the amount of acid (perchloric or hydrochloric) needed to neutralize all of the overbased material's basicity. The amount of acid is expressed as potassium hydroxide equivalents. Total base number is determined by titration of one gram of overbased material with 0.1 Normal hydrochloric acid solution using bromophenol blue as an indicator. The overbased materials of the present invention generally have a total base number of at least 20, preferably 100, more preferably 200. The overbased material generally have a total base number up to 600, preferably 500, more preferably 400. The total base number is essential to the invention because the inventors have discovered that the ratio of the equivalents of overbased material based on total base number to the equivalents of hydrocarbyl phosphite based on phosphorus atoms must be at least one to make the thermally stable lubricating compositions of the present invention. The equivalents of overbased material is determined by the following equation: equivalent weight=(56,100/total base number). For instance, an overbased material with a total base number of 200 has an equivalent weight of 280.5 (eq. wt=56100/200).

Ordinary, or neutral, salts are prepared by the simple reaction of the initial product of the invention with a basic metal material in stoichiometric amounts. It is also possible to employ less than a stoichiometric amount of base, in which case the product will be a mixture of the initial acid or lactone and the salt.

The overbased materials, on the other hand, are preferably prepared by reacting a mixture comprising the initial acidic product of the present invention, a reaction medium comprising at least one inert, organic solvent (mineral oil, naphtha, toluene, xylene, etc.) for the initial product of the invention, a stoichiometric excess of a metal base, and a promoter.

The metal compounds useful in making the basic metal salts are generally any Group I or Group II metal compounds (CAS version of the Periodic Table of the Elements). The Group I metals of the metal compound include alkali metals (group IA: sodium, potassium, lithium, etc.) as well as Group IB metals. The Group I metals are preferably sodium, potassium, lithium and copper, more preferably sodium or potassium, and more preferably sodium. The Group II metals of the metal base include the alkaline earth metals (group IIa: magnesium, calcium, barium, etc.) as well as the Group IIB metals such as zinc or cadmium. Preferably the Group II metals are magnesium, calcium, or zinc, preferably magnesium or calcium, more preferably calcium. Generally the metal compounds are delivered as metal salts. The anionic portion of the salt can be hydroxyl, oxide, carbonate, borate, nitrate, etc.

While overbased metal salts can be prepared by merely combining an appropriate amount of metal base and carboxylic acid substrate, the formation of useful overbased compositions is facilitated by the presence of an additional acidic material. The acidic material can be a liquid such as formic acid, acetic acid, nitric acid, sulfuric acid, etc. Acetic acid is particularly useful. Inorganic acidic materials may also be used such as HCl, $SO_2$, $SO_3$, $CO_2$, $H_2S$, etc., preferably $CO_2$. When $CO_2$ is employed, the product is referred to as a carbonate overbased (or carbonated) material; when $SO_2$, sulfite overbased (or sulfited); when $SO_3$, sulfate overbased (or sulfated). When sulfite overbased materials are further treated with elemental sulfur or an alternative sulfur source, thiosulfate overbased materials can be prepared. When overbased materials are further reacted with a source of boron, such as boric acid or borates, borated overbased materials are prepared. Thus carbonate overbased materials can be reacted with boric acid, with or without evolution of carbon dioxide, to prepare a borated material.

A promoter is a chemical employed to facilitate the incorporation of metal into the basic metal compositions. The promoters are quite diverse and are well known in the art, as evidenced by the cited patents. A particularly comprehensive discussion of suitable promoters is found in U.S. Pat. Nos. 2,777,874, 2,695,910, and 2,616,904. These include the alcoholic and phenolic promoters, which are preferred. The alcoholic promoters include the alkanols of one to about twelve carbon atoms such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Patents specifically describing techniques for making basic salts of the above-described sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Attention is drawn to these patents for their disclosures in this regard as well as for their disclosure of specific suitable basic metal salts.

The overbased materials can be represented by the general formula $$A^{y-}M^{y+}$$

wherein M represents one or more metal ions, y is the total valence of all M and A represents one or more anion containing groups derived from the initial product of the invention, having a total of about y individual anionic moieties.

These metal salts can be represented by the structure

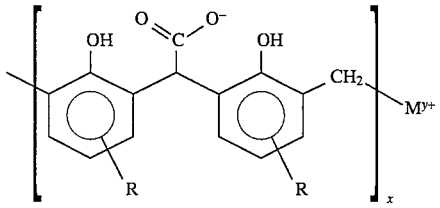

where the unspecified linkages are as described above.

The expressions "represented by the structure" or "represented by," as used in this application, means that the material in question has the chemical structure as indicated or has a related and generally equivalent structure. Thus, for example, an anion "represented by" a structure which shows an ionized carboxylic group and non-ionized phenolic OH groups, as the above, could also, in part or in whole, consist of materials in which one or more of the phenolic OH groups are ionized. Tautomeric structures and positional isomeric structures are also included.

EXAMPLE 22

A mixture of 2062 parts of the material from Example 1 and 80 parts of 50% aqueous sodium hydroxide is heated for 2 hours at 95° C. The reacction mixture is thereafter cooled to 60° C. and stripped by applying vacuum to gradually reduce the pressure to 13 kPa (100 mm Hg). The pressure is gradually further decreased and the temperature increased over 4 hours until 95° C. and 2.7 kPa (20 mm Hg) are attained. The mixture is held under these conditions for 3 hours to complete removal of volatiles. The residue is filtered through a diatomaceous earth filter at 95° C. to yield the filtrate as the product.

EXAMPLE 23

A mixture of 2062 parts of the product of EXAMPLE 1, 111 parts calcium chloride, and 1000 parts water is heated for 4 hours at 100° C., and stripping is begun by applying a vacuumn to gradually reduce the pressure to 13 kPa (100 mm Hg). The pressure is gradually further decreased and the temperature increased over 6 hours until 120° C. and 2.7 kPa (20 mm Hg) are attained. The mixture is held under these conditions for 3 hours to complete removal of volatiles. The residue is filtered through a diatomaceous earth filter at 120° C. to yield the filtrate as the product.

EXAMPLE 24

The product prepared as in Example 20, 2586 g, and 140 g diluent oil, are added to a 5 L flask equipped with stirrer, thermowell, subsurface inlet tube, and cold water condenser. The mixture is heated to 93° C. A solution of $CaCl_2$, 143 g, in 168 g water is added at 93° C. and mixed for 15 minutes. $Ca(OH)_2$, 185 g, is added and mixed for 15 minutes at 90°–95° C. The mixture is heated under nitrogen flow, 28 L/hr (1 std. $ft^3$/hr), to 150° C. to remove volatiles. The mixture is cooled, and 260 g methanol is added. The mixture is heated to 50°–52° C. and $CO_2$ addition is begun, at 28 L/hr (1 std. $ft^3$/ hr). After about 2 hours the mixture is heated to 150° C. and maintained at that temperature for 1 hour, to remove volatiles. The mixture is cooled, then reheated to 100° C. and isolated by centrifugation and filtration to remove solids.

The above-described materials can be formulated into lubricants which can be used to lubricate internal combustion engines (2-cycle and 4-cycle, including high temperature ceramic engines) as well as other lubricant applications. In each application the lubricant is supplied in the appropriate manner, e.g., from an engine sump, for a conventional 4-cycle engine, or as an admixture with fuel, for a conventional 2-cycle engine.

Lubricants will be formulated in an oil of lubricating viscosity, which can include natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of dicarboxylic acids and polyols, esters of phosphorus-containing acids, polymeric tetrahydrofurans and silicon-based oils.

Specific examples of the oils of lubricating viscosity are described in U.S. Pat. No. 4,326,972 and European Pat. Publication 107,282. A basic, brief description of lubricant base oils appears in an article by D. V. Brock, "Lubricant Base Oils", *Lubrication Engineering*, Volume 43, pages 184–185, March, 1987, which can be consulted for its disclosures relating to lubricating oils. A more detailed description of oils of lubricating viscosity also may be found in U.S. Pat. No. 4,582,618 (column 2, line 37 through column 3, line 63, inclusive).

The amount of the oil of lubricating viscosity will generally be the balance of the composition after the additives hereindescribed, including optional additional additives, are accounted for. In a fully formulated lubricant the amount of the oil of lubricating viscosity will generally be 50% or greater (including the amounts, if any, of diluent oils), preferably 0.5 to 15%, more preferably 2 to 12 percent. In a concentrate, described more fully below, the amount of oil will be proportionately reduced.

The fully formulated lubricant will contain an amount of the additive suitable to function in its intended role. Thus the initial product of the invention will be used in an amount suitable to function as a dispersant, typically 0.5 to 15 percent by weight, preferably 1 or 2 to 12 percent. The reaction product of an amine or an alcohol will generally be used in an amount suitable to function as a dispersant. Typical amounts would be 0.5 or 1 to 20 percent by weight, preferably 1 or 2 to 12 percent, more preferably 4 to 8 percent by weight. The salt or overbased salt of the present invention will generally be used in an amount suitable to function as a detergent. Typical amounts would be 0.1 or 0.2 to 8 percent by weight, preferably 0.3 or 0.5 to 5 percent, more preferably 0.8 to 3 percent. (These amounts are presented on an oil-free basis, i.e., in the absence of any diluent oil.)

EXAMPLE 24

A minimally formulated lubricant is prepared by admixing 4.4% by weight of the product of Example 16 in an Exxon™ 5W-30 oil.

EXAMPLE 25

A lubricant formulation is prepared by admixing an additive package with Exxon™ 15W-40 oil, as well as 7.5% by weight of a commercial polymethacrylate viscosity modifier. The additive package is a conventional internal combustion engine lubricant additive package except that the customary dispersant therein is replaced by 4.9 percent by weight of the product of EXAMPLE 4. Other components in the additive package include about 2%–3% each of a polyisobutenyl succinic anhydride partially esterified with polyols and further reacted with polyamines, calcium overbased sulfur-bridged alkyl phenols, and overbased calcium and magnesium sulfonates, about 1% of a zinc dialkyldithiophosphate, and smaller amounts of an antioxidant and an antifoam agent, to total 13.3 percent by weight additives, based on the total weight of the composition. The composition exhibits good oxidative stability, thermal stability, and dispersancy.

It is sometimes useful to incorporate, on an optional, as-needed basis, other known additives which include, but are not limited to, dispersants and detergents of the ash-producing or ashless type, antioxidants, anti-wear agents, extreme pressure agents, emulsifiers, demulsifiers, foam inhibitors, friction modifiers, anti-rust agents, corrosion inhibitors, viscosity improvers, pour point depressants, dyes, lubricity agents, and solvents to improve handleability which may include alkyl and/or aryl hydrocarbons. These optional additives may be present in various amounts depending on the intended application for the final product or may be excluded therefrom.

The additives and components of this invention can be added directly to the lubricant. Preferably, however, they are diluted with a substantially inert, normally liquid organic diluent such as mineral oil, naphtha, toluene or xylene, to form an additive concentrate. These concentrates usually contain 5% to 90% by weight, preferably 10 to 85%, more preferably 20 to 60%, of the components used in the composition of this invention and may contain, in addition, one or more other additives known in the art as described hereinabove. The remainder of the concentrate is the substantially inert normally liquid diluent (typically 10 to 95%, preferably 15 to 60%).

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A composition of matter suitable for use as an internal combustion engine lubricant additive, comprising the reaction product of one or more hydroxyaromatic compounds, most of the units of which are hydrocarbyl-substituted; provided that if the hydroxyaromatic compound comprises bridged ring units, then substantially all such units are hydroxyl- and hydrocarbyl-substituted; a carboxy-substituted carbonyl compound, or a source thereof; and a carbonyl compound other than a carboxy-substituted carbonyl compound, or a source thereof.

2. The composition of claim 1 wherein the carboxyl-substituted carbonyl compound is a carboxyl-substituted aldehyde.

3. The composition of claim 2 wherein the carboxy-substituted aldehyde is a material of the structure $$H-\overset{\overset{\displaystyle O}{\|}}{C}-(CH_2)_n-\overset{\overset{\displaystyle O}{\|}}{C}-OR$$

where n is zero to about 5 and R is hydrogen or hydrocarbyl, or a source thereof.

4. The composition of claim 2 wherein the carboxyl-substituted aldehyde is glyoxylic acid or a source thereof.

5. The composition of claim 1 wherein the carbonyl compound other than a carboxy-substituted carbonyl compound is an aldehyde of the general formula RC(O)H where R is hydrogen or a hydrocarbyl group and where the aldehyde comprises 1 to about 12 carbon atoms, or a source thereof.

6. The composition of claim 5 wherein the aldehyde other than a carboxy-substituted aldehyde is formaldehyde or a source thereof.

7. The composition of claim 1 wherein the moieties derived from the hydroxyaromatic compound, the carboxy-substituted carbonyl compound, and the other carbonyl compound are present in molar ratios of about 2:(0.1 to 1.5):( 1.9 to 0.5).

8. The composition of claim 7 wherein the molar ratio is about 2:(0.8 to 1.1):(1.2 to 0.9).

9. The composition of claim 1 wherein the composition is prepared by reacting the hydroxyaromatic compound, the carboxy-substituted carbonyl compound or source thereof; and the carbonyl compound other than a carboxy-substituted carbonyl compound or source thereof under condensing conditions.

10. The composition of claim 9 wherein the hydroxyaromatic compound is reacted first with the carboxy-substituted carbonyl compound or source thereof, and there reaction product thereof is further reacted with the carbonyl compound other than a carboxy-substituted carbonyl compound or source thereof.

11. The composition of claim 9 wherein the reaction is conducted in the presence of acid catalyst with removal of water of condensation.

12. A lubricant composition comprising an oil of lubricating viscosity and a minor amount of the composition of claim 1.

13. A concentrate comprising the composition of claim 1 and a concentrate-forming amount of an oil of lubricating viscosity.

14. A method for lubricating an internal combustion engine comprising supplying to the engine the lubricant of claim 12.

15. A composition prepared by reacting the reaction product of one or more hydroxyaromatic compounds, most of the units of which are hydrocarbyl-substituted; provided that if the hydroxyaromatic compound comprises bridged ring units, then substantially all such units are hydroxyl- and hydrocarbyl-substituted; a carboxy-substituted carbonyl compound, or a source thereof; and a carbonyl compound other than a carboxy-substitued carbonyl compound, or a source thereof with a polyol or a polyol ether.

16. A composition prepared by reacting the reaction product of one or more hydroxyaromatic compounds, most of the units of which are hydrocarbyl-substituted; provided that if the hydroxyaromatic compound comprises bridged ring units, then substantially all such units are hydroxyl- and hydrocarbyl-substituted, a carboxy-substituted carbonyl compound, or a source thereof; and a carbonyl compound other than a carboxy-substituted carbonyl compound, or a source thereof with an amine.

17. The composition of claim 16 wherein the reaction is conducted in the presence of an inert diluent.

18. The composition of claim 16 wherein the amine is a polyamine.

19. The composition of claim 18 wherein the polyamine is a poly(ethyleneamine).

20. The composition of claim 18 wherein the polyamine is amine bottoms.

21. The composition of claim 16 wherein the amount of the amine relative to the amount of the carboxy-substituted carbonyl moieties is such that the ratio of C=O groups to N atoms in the product is about 1:1 to about 1:5.

22. The composition of claim 21 wherein the ratio of C=O groups to N atoms is about 1:1.5 to about 1:2.0.

23. A lubricant composition comprising an oil of lubricating viscosity and an amount of the composition of claim 16 sufficient to serve as a dispersant.

24. The lubricant of claim 23 wherein the amount of the dispersant composition is about 1 to about 12 percent by weight.

25. A concentrate comprising the composition of claim 16 and a concentrate-forming amount of an oil of lubricating viscosity.

26. A method for lubricating an internal combustion engine comprising supplying to the engine the lubricant of claim 23.

27. A composition comprising the reaction product of one or more hydroxyaromatic compounds, most of the units of which are hydrocarbyl-substituted; provided that if the hydroxyaromatic compound comprises bridged ring units, then substantially all such units are hydroxyl- and hydrocarbyl-substituted; a carboxy-substituted carbonyl compound, or a source thereof; and a carbonyl compound other than a carboxy-substituted carbonyl compound, or a source thereof, wherein the product is reacted with a basic metal compound to form a metal salt.

28. The composition of claim 27 wherein the metal is selected from sodium, magnesium, calcium, barium, arid zinc.

29. The composition of claim 27 wherein the salt is overbased.

30. The composition of claim 29 wherein the overbased salt is treated with a low molecular weight acidic material.

31. The composition of claim 30 wherein the low molecular weight acidic material is carbon dioxide.

32. The composition of claim 30 wherein the metal ratio of the salt is about 1.1 to about 40.

33. The composition of claim 32 wherein the metal ratio of the salt is about 1.5 to about 6.

34. A lubricant composition comprising an oil of lubricating viscosity and an amount of the composition of claim 27 sufficient to serve as a detergent.

35. The lubricant of claim 34 wherein the amount of the detergent composition is about 0.2 to about 5 percent by weight.

36. A concentrate comprising the composition of claim 27 and a concentrate-forming amount of an oil of lubricating viscosity.

37. A method for lubricating an internal combustion engine comprising supplying to the engine the lubricant of claim 34.

38. A composition of a paraffinic liquid and an amount of a pour point depressant comprising the reaction product of one or more hydroxyaromatic compounds, most of he units of which are hydrocarbyl-substituted; provided that if the hydroxyaromatic compound comprises bridged ring units, then substantially all such units are hydroxyl- and hydrocarbyl-substituted: a carboxy-substituted carbonyl compound, or a source thereof; and a carbonyl compound other than a carboxy-substituted carbonyl compound, or a source thereof, sufficient to reduce the pour point of said paraffinic liquid.

39. The composition of claim 38 wherein the amount of the pour point depressant is about 100 to about 2000 parts per million of the composition.

40. A method for reducing the pour point of a paraffinic liquid comprising admixing with the liquid a pour-point reducing amount of the reaction product of one or more hydroxyaromatic compounds, most of the units of which are hydrocarbyl-substituted; provided that if the hydroxyaromatic compound comprises bridged ring units, then substantially all such units are hydroxyl- and hydrocarbyl-substituted; a carboxy-substituted carbonyl compound, or a source thereof; and a carbonyl compound other than a carboxy-substituted carbonyl compound, or a source thereof.

41. A composition of matter comprising the reaction product of one or more hydrocarbyl-substituted phenols; a carboxy-substituted carbonyl compound, or a source thereof; and a carbonyl compound other than a carboxy-substituted carbonyl compound, or a source thereof.

42. The composition of claim 41 wherein the hydrocarbyl-substituted phenol is an alkyl phenol.

43. The composition of claim 42 wherein the alkyl phenol is a phenol substituted by an alkyl group containing about 8 to about 400 carbon atoms.

44. The composition of claim 43 wherein the alkyl group contains about 12 to about 100 carbon atoms.

45. The composition of claim 42 wherein the alkyl phenol component is a mixture of alkyl phenols comprising molecules which contain alkyl substituents of about 4 to about 8 carbon atoms and molecules which contain alkyl substituents of about 9 to about 400 carbon atoms.

46. The composition of claim 43 wherein the alkyl group has a number average molecular weight of about 150 to about 2000.

47. The composition of claim 43 wherein the alkyl group has a number average molecular weight of about 200 to about 1200.

48. A composition of matter comprising the reaction product of one or more hydroxyaromatic compounds, most of the units of which are hydrocarbyl-substituted; provided that if the hydroxyaromatic compound comprises bridged ring units, then substantially all such units are hydroxyl- and hydrocarbyl-substituted; a carboxy-substituted carbonyl compound, or a source thereof; and a carbonyl compound other than a carboxy-substituted carbonyl compound, or a source thereof;

wherein said reaction product is a substantially alternating oligomer containing about 4 to about 10 hydroxyaromatic units.

49. The composition of claim 48 comprising molecules containing the structures

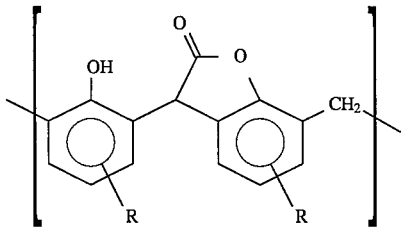

or

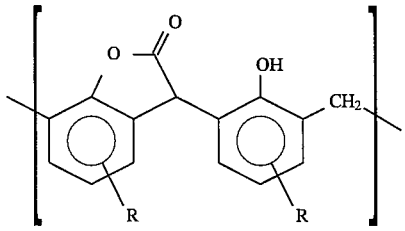

where each R is independently a hydrocarbyl group.

50. A composition of matter comprising the reaction product of one or more hydroxyaromatic compounds, most of the units of which are hydrocarbyl-substituted; provided that if the hydroxyaromatic compound comprises bridged ring units, then substantially all such units are hydroxyl- and hydrocarbyl-substituted; a carboxy-substituted carbonyl compound, or a source thereof; and a carbonyl compound other than a carboxy-substituted carbonyl compound, or a source thereof;

wherein the composition is prepared by reacting the hydroxyaromatic compound, the carboxy-substituted carbonyl compound or source thereof, and the carbonyl compound other than a carboxy-substituted carbonyl compound or source thereof under condensing conditions; wherein the components are reacted simultaneously.

51. A composition of matter comprising the reaction product of one or more hydroxyaromatic compounds, most of the units of which are hydrocarbyl-substituted; provided that if the hydroxyaromatic compound comprises bridged ring units, then substantially all such units are hydroxyl- and hydrocarbyl-substituted; a carboxy-substituted carbonyl compound, or a source thereof; and a carbonyl compound other than a carboxy-substituted carbonyl compound, or a source thereof;

wherein the hydroxyaromatic compound is reacted first with the carbonyl compound other than a carboxy-substituted carbonyl compound or source thereof and thereafter with the carboxy-substituted carbonyl compound or source thereof, under condensing conditions.

* * * * *